US005934352A

United States Patent [19]

Morgan

[11] Patent Number: 5,934,352

[45] Date of Patent: Aug. 10, 1999

[54] GARAGE DOOR PANEL CONSTRUCTION

[75] Inventor: Brian H. Morgan, Dixon, Ill.

[73] Assignee: Raynor Garage Doors, Dixon, Ill.

[21] Appl. No.: 08/857,089

[22] Filed: May 15, 1997

[51] Int. Cl.[6] ..... E05D 15/06

[52] U.S. Cl. ..... 160/201; 160/229.1; 16/267

[58] Field of Search ..... 160/235, 229.1, 160/201; 16/267

[56] References Cited

U.S. PATENT DOCUMENTS

| | | |
|---|---|---|
| 1,530,762 | 3/1925 | Dautrick . |
| 1,621,669 | 3/1927 | Johnson . |
| 1,626,844 | 5/1927 | Kuhn . |
| 1,724,995 | 8/1929 | Dautrick . |
| 1,750,042 | 3/1930 | Hoover . |
| 1,827,433 | 10/1931 | Kendall . |
| 1,888,162 | 11/1932 | Eklund . |
| 1,990,870 | 2/1935 | Kelly . |
| 1,994,142 | 3/1935 | Madsen . |
| 1,995,644 | 4/1935 | Lowe et al. . |
| 2,017,012 | 10/1935 | Morgan . |
| 2,059,833 | 11/1936 | Winn, Jr. . |
| 2,093,019 | 9/1937 | Norberg . |
| 2,099,191 | 11/1937 | Blodgett . |
| 2,134,397 | 10/1938 | Clark . |
| 2,166,746 | 7/1939 | Bartel . |
| 2,557,716 | 6/1951 | Allee . |
| 2,641,792 | 6/1953 | Peeler . |
| 2,681,480 | 6/1954 | Dixon, Sr. . |
| 2,694,234 | 11/1954 | Roby et al. . |
| 2,817,875 | 12/1957 | Harris et al. . |
| 2,852,840 | 9/1958 | Harvey . |
| 2,871,932 | 2/1959 | Stroup . |
| 2,910,741 | 11/1959 | Dettman . |
| 2,952,313 | 9/1960 | Stroup ..... 160/229.1 X |
| 2,968,829 | 1/1961 | Meddick ..... 160/229.1 X |
| 3,013,410 | 9/1961 | Dobbins . |
| 3,160,200 | 12/1964 | McKee et al. . |
| 3,165,143 | 1/1965 | Jackwig . |
| 3,198,242 | 8/1965 | Crosswell . |
| 3,302,690 | 2/1967 | Hurd . |
| 3,319,697 | 5/1967 | Krohn . |
| 3,322,586 | 5/1967 | Hasenwinkle et al. . |
| 3,347,305 | 10/1967 | Urbanick . |
| 3,359,594 | 12/1967 | Pastoor . |
| 3,566,448 | 3/1971 | Ernst . |
| 3,635,277 | 1/1972 | Bahnsen . |
| 3,648,755 | 3/1972 | Thiele . |
| 3,869,269 | 3/1975 | Knapp . |
| 3,893,269 | 7/1975 | Nelsson et al. . |
| 3,934,635 | 1/1976 | Kin . |
| 3,941,180 | 3/1976 | Thill . |
| 4,040,142 | 8/1977 | Ippolito . |
| 4,151,031 | 4/1979 | Goad et al. . |
| 4,238,544 | 12/1980 | Mullet . |
| 4,269,253 | 5/1981 | Ziegler . |

(List continued on next page.)

FOREIGN PATENT DOCUMENTS

| | | |
|---|---|---|
| 0370324 | 5/1990 | European Pat. Off. . |
| 0370376 | 5/1990 | European Pat. Off. . |
| 0438046 | 7/1991 | European Pat. Off. . |
| 0612910 | 8/1994 | European Pat. Off. . |
| 3814275 | 4/1987 | Germany . |
| 3922981 | 11/1988 | Germany . |
| 3922995 | 11/1988 | Germany . |
| 9206018 U | 5/1992 | Germany . |
| 4227311 | 2/1994 | Germany . |
| 9406615 U | 4/1994 | Germany . |
| WO3909325 | 5/1993 | WIPO . |

*Primary Examiner*—Blair M. Johnson
*Attorney, Agent, or Firm*—Banner & Witcoff Ltd

[57] ABSTRACT

A series of rectangular horizontal, garage door panels are joined together by an integral hinge construction which enables the panels to be manufactured at a factory site and assembled at a construction site. The panels as well as the hinge elements may be fabricated from a fiberglass, reinforced, composite or other polymeric materials to enhance the durability of the garage door construction.

18 Claims, 4 Drawing Sheets

U.S. PATENT DOCUMENTS

| | | | |
|---|---|---|---|
| 4,284,118 | 8/1981 | Ceron . | |
| 4,339,487 | 7/1982 | Mullet . | |
| 4,348,164 | 9/1982 | Fujii et al. . | |
| 4,387,760 | 6/1983 | Greschbach . | |
| 4,472,910 | 9/1984 | Iha . | |
| 4,667,724 | 5/1987 | Dragone . | |
| 4,685,266 | 8/1987 | Mullet . | |
| 4,878,267 | 11/1989 | Roach et al. . | |
| 4,893,666 | 1/1990 | Hormann . | |
| 4,989,660 | 2/1991 | Wagner . | |
| 5,001,862 | 3/1991 | Albenda . | |
| 5,002,114 | 3/1991 | Hormann | 160/229.1 |
| 5,036,899 | 8/1991 | Mullet . | |
| 5,043,128 | 8/1991 | Umeda . | |
| 5,103,890 | 4/1992 | Cloutier . | |
| 5,170,832 | 12/1992 | Wagner . | |
| 5,522,446 | 6/1996 | Mullett et al. | 160/229.1 |
| 5,555,923 | 9/1996 | Leist et al. | 160/299.1 |

FIG.3
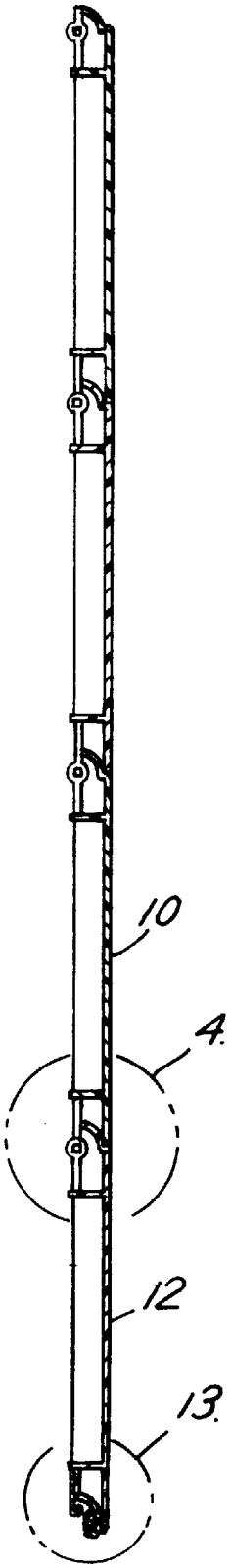
FIG.4
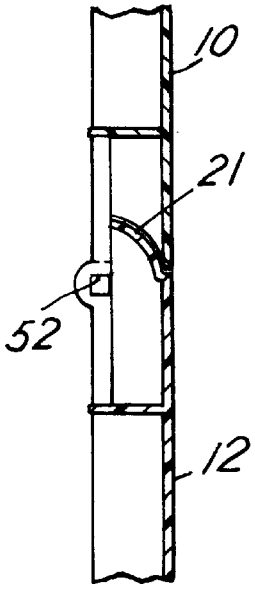
FIG.6
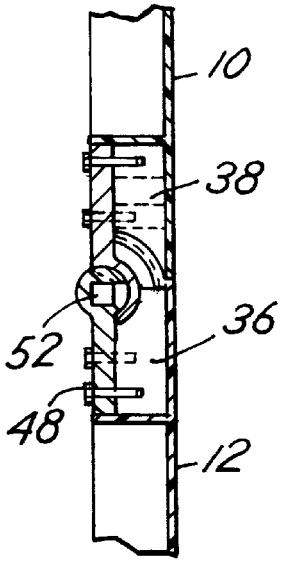
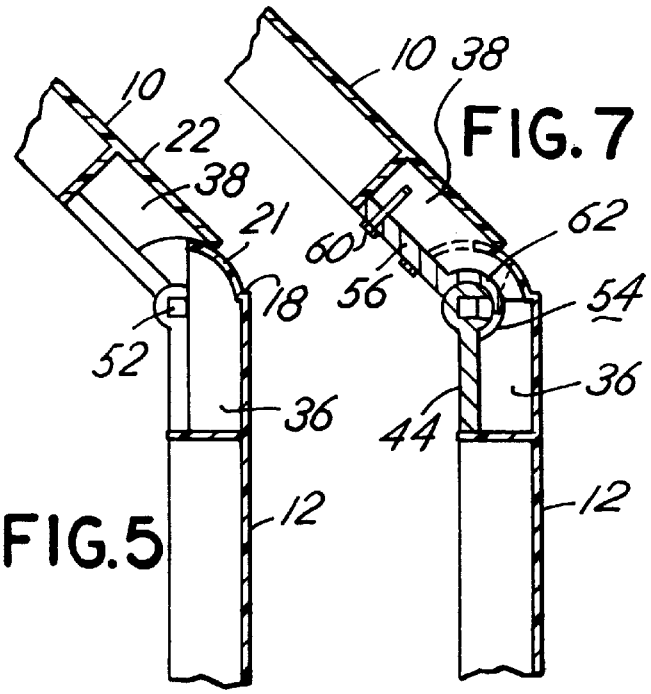
FIG.7
FIG.5

10.
56
42
58
52
9.
62
40
10.
46
44
9.

58
56
64
60
42
66
62
50
40
44
48

46

56
42
66
62

50
52
40
44

GARAGE DOOR PANEL CONSTRUCTION

BACKGROUND OF THE INVENTION

This invention relates to a garage door construction, and more particularly, to a garage door comprised of multiple panels hinged along their horizontal edges to one another whereby the panels may be articulated with respect to one another when moving from the door closed to the door open position and vice versa. More particularly, this invention relates to a garage door construction comprised of reinforced polymeric panels hinged along their horizontal edges to one another. Additionally, the hinges may be decoupled or coupled at a field assembly site by articulating adjacent hinged panels with respect to one another at an angle exceeding the maximum angle of articulation associated with normal operation of the door.

Heretofore, garage doors have been fabricated from wood, steel or composite materials. Such garage doors are typically manufactured from a series of rectangular, horizontal panels which are aligned one over the other to form a vertical, multiple panel door. Hinges connect the horizontal edges of adjacent panels so that the panels may articulate one with respect to the other when the door is moved from the closed to the open position or vice versa Construction of such doors using wood panels has been useful; however, the wood often deteriorates or rots and the surface of the wood must constantly be repaired, such as by painting. Utilization of steel panels also has some disadvantages. Steel panels require significant attention because they may rust. Additionally, the panel surfaces on steel panels often easily dent and thus become unsightly.

It has been proposed to use polymeric materials for the formation of a garage door having multiple hinged panels. For example, Overhead Door Corp. of Dallas, Tex., offers an door panel having an expanded urethane center core and an outside vinyl coating or skin. Other manufacturers offer similar types of door panels manufactured from polymeric materials.

Nonetheless, there have remained problems with respect to such doors. The mechanical integrity of such doors is difficult to maintain. The manufacturing processes may be expensive and complex. Consequently, there has developed the need for an improved garage door construction.

BRIEF DESCRIPTION OF THE INVENTION

In a principal aspect, the present invention comprises a multiple panel garage door wherein each of the generally rectangular, horizontal panels is formed from a molded polymeric or composite material. The panels are hinged together along their horizontal edges so that the panels may be articulated when transferred from a closed to an open position. The panels include track wheel receptors enabling the use of track wheels attached to the side edges of the panels to engage in tracks that guide the movement of the garage door between the open and closed position.

The hinge construction, which is used to connect the articulated panels, includes separate hinge leaves attached respectively to adjacent panels with one of the leaves including a generally cylindrical pintle and the other leaf including a semi-cylindrical section or arm which slidably fits over the pintle and is retained between the pintle and a shaped surface formed in the back side of the molded garage door panel itself. The pintle may include a track wheel shaft opening for receipt of a track wheel support shaft. The hinge leaves are constructed of metal or polymeric material and articulate in the normal operating range of a garage door up to 74° with respect to one another while retaining the horizontal panel sections engaged one with the other. Additional articulation of the panels beyond 120° enables removal or disengagement or decoupling of the hinge leaves from one another and thus disengagement of adjacent panels. One of the hinge leafs further includes lateral skirts which overlap the pintle and the joint between the hinge leaves so as to eliminate pinch points.

Thus, it is an object of the invention to provide an improved garage door construction.

It is a further object of the invention to provide a garage door construction comprised of multiple horizontal, rectangular panels joined together along their horizontal edges so that they may articulate one with respect to the other when moving a garage door from a closed to an open position and vice versa.

Yet another object of the invention is to provide a garage door panel construction of polymeric or composite, reinforced polymeric materials wherein the garage door panels are molded in a single operation and wherein the garage door panels are adapted to receive hinges or hinge leaves which permit ease of assembly of the garage door panels with one another at a construction site.

Yet a further object of the invention is to provide a hinge construction for hinging garage door panels together whereby the hinge eliminates pinch points at the connection of the hinge leaves.

Yet another object of the invention is to provide a design for garage door panels wherein the horizontal edges of the panels are shaped to reduce or eliminate pinch points between adjacent panels as they articulate one with respect to the other.

A further object of the invention is to provide an improved garage door panel and hinge construction wherein the panels may be fabricated with the hinge leaves thereon at a factory site and then shipped to an assembly or building site and easily assembled with one another.

Yet another object of the invention is to provide an improved garage door construction wherein tracking wheels may be easily engaged with and coupled to the hinge elements or leaves which connect adjacent horizontal panels with one another.

A further object of the invention is to provide a garage door construction which is economic to manufacture, easy to assemble and wherein each of the separate components of the assembly are mechanically strong.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is a side cross sectional view of multiple panels;

FIG. 4 is an enlarged side cross sectional view of the panels depicted in FIG. 3;

FIG. 5 is a side cross sectional view of articulated panels;

FIG. 6 is an enlarged cross sectional view of the hinge between adjacent panels;

FIG. 7 is an enlarged side cross sectional view of the panels of FIG. 6 as articulated;

DESCRIPTION OF THE PREFERRED EMBODIMENT

Figure 1:
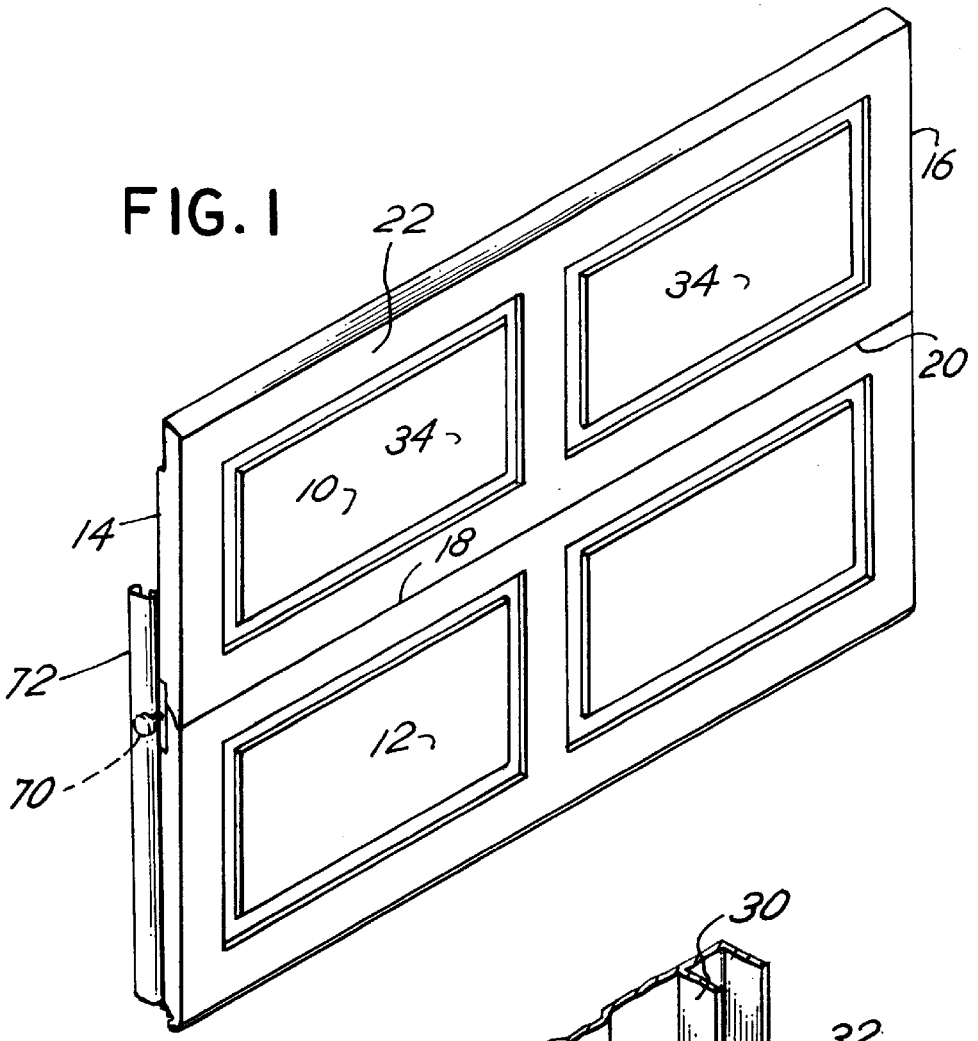
FIG. 1 is an isometric view of the panels of a garage door construction as viewed from the front of the door or from the outside of the door.
Figure 2:
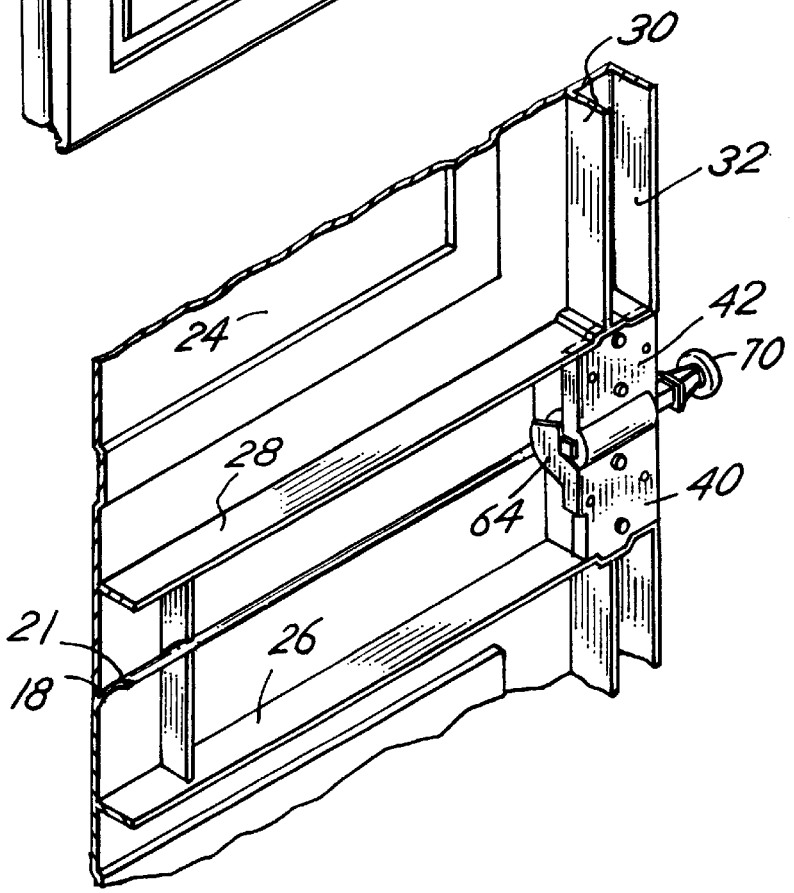
FIG. 2 is an isometric view of the panels of FIG. 1 from the back side.
Figure 8:
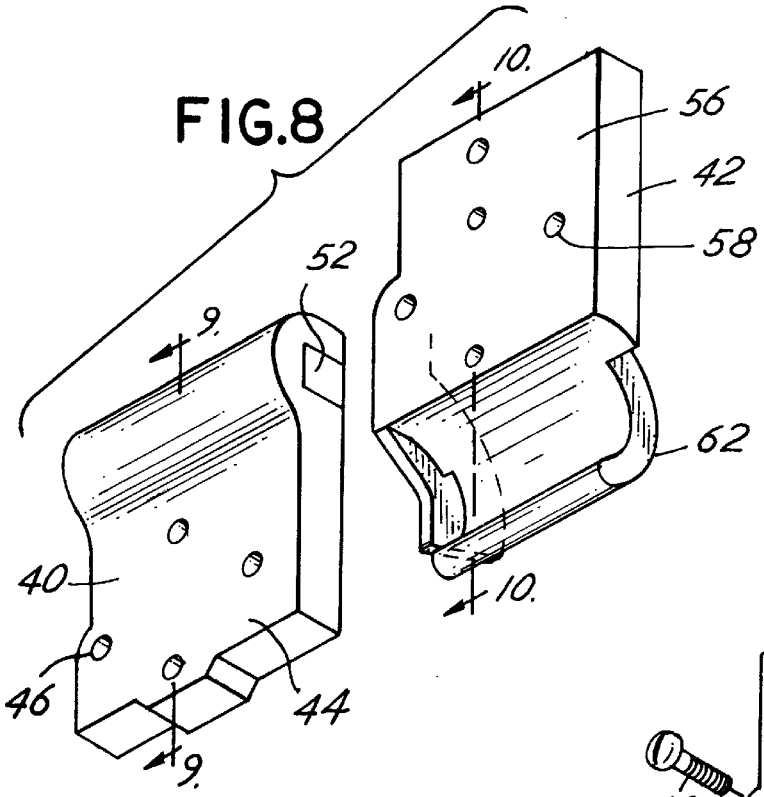
FIG. 8 is an exploded isometric view of the hinge members.
Figure 11:
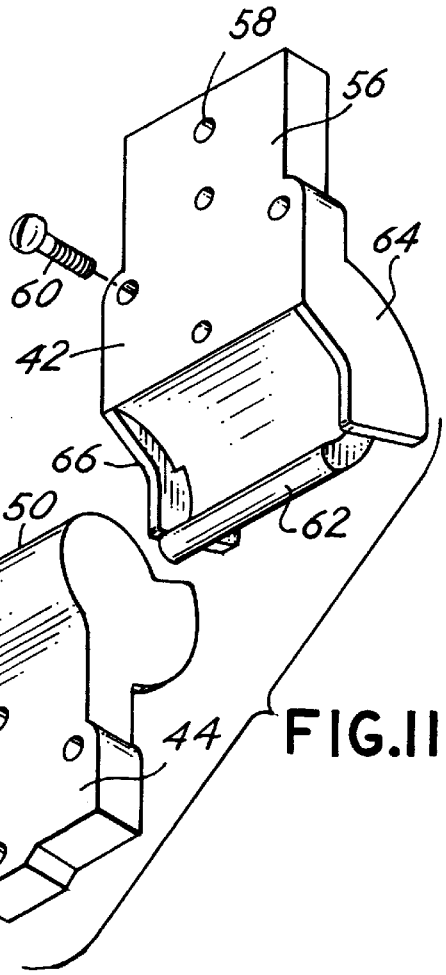
FIG. 11 is an enlarged isometric view of cooperating hinge members.
Figure 10:
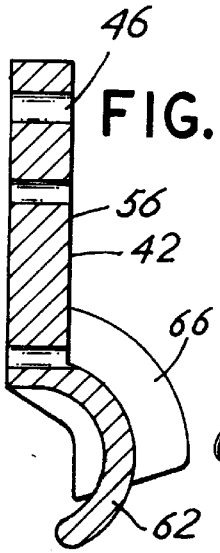
FIG. 10 is a side cross sectional view of a hinge member taken along the line 10—10 in FIG. 8.
Figure 9:
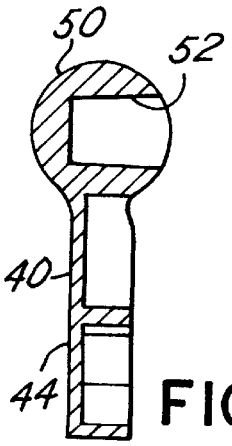
FIG. 9 is a side cross sectional view of a hinge leaf taken along the line 9—9 in FIG. 8.
Figure 12:
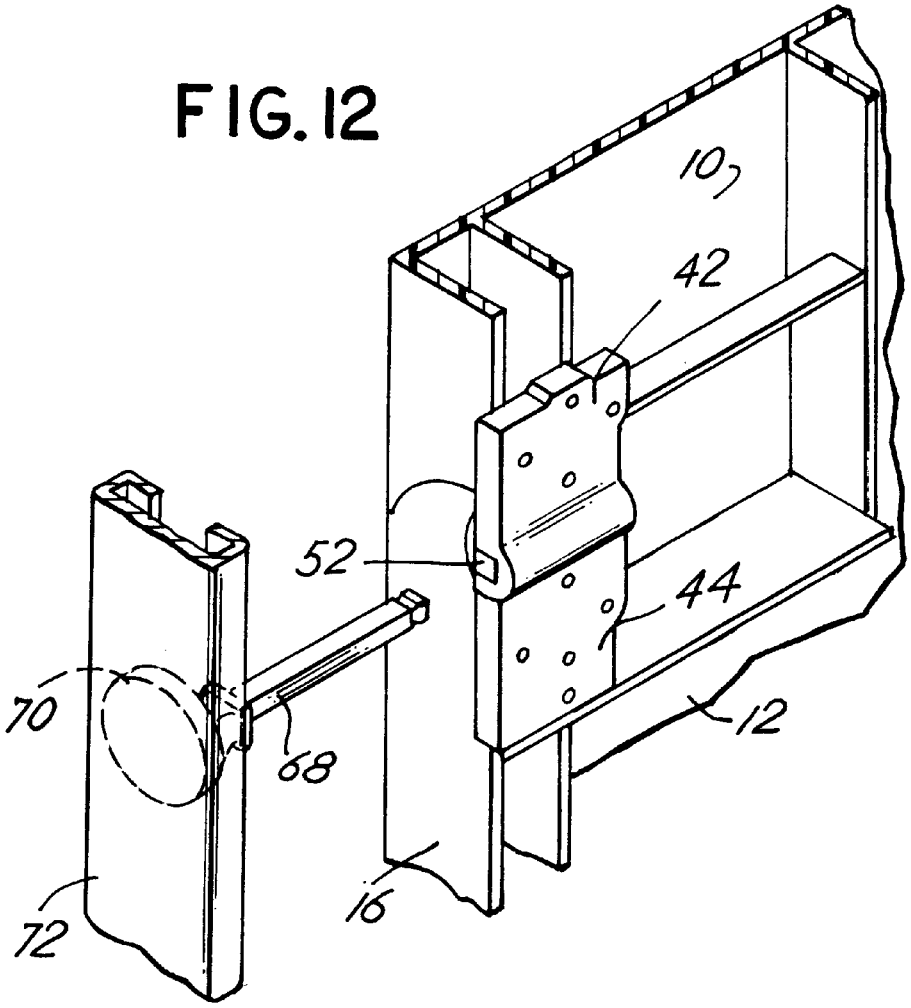
FIG. 12 is an exploded isometric view of the adjacent panels and connecting hinge members.
Figure 13:
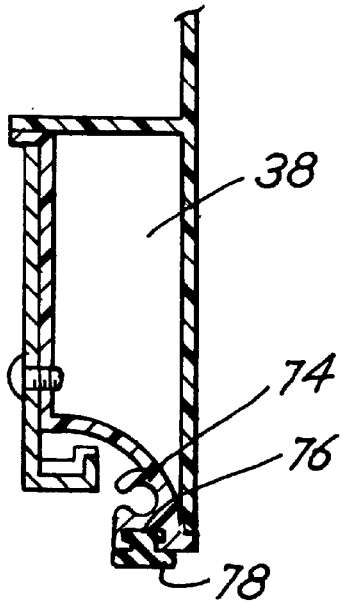
FIG. 13 is an enlarged cross sectional view of the bottom edge of a bottom panel in a garage door construction.

Referring to figures, the present invention is incorporated in a garage door of the type including generally rectangular, horizontal panels such as panels 10 and 12. The panels 10 and 12 are molded from polymeric or composite materials, preferably those known as fiberglass reinforced polyester composites. The panels 10, 12 are molded in a single piece from such materials and provide a tough, dent proof and scratch resistant surface which is aesthetically pleasing and which may be molded to replicate a carved or recessed wood panel design. Importantly, the panels 10, 12 are molded in one piece. Also, each panel 10, 12 has molded therein all structural and hardware mounting features so that it is unnecessary to add elements to the panels, other than the hinge elements which are described below. It is noted that the hinges described below may be molded from polymeric or composite materials or may be made from metal. Finally, the hinge elements, which are described below, are pre-installed at the factory site on each of the separate panels 10, 12. The panels 10, 12 then may be interconnected at a field or construction site.

The material from which the panels are made is typically a composite material comprised of three (3) or more ingredients as follows: approximately 30% of the weight of the material is a fiberglass or reinforcing material; approximately 30% is a filler material such as a mineral filler (e.g., limestone); 30% is a polyester resin or other binder and the remaining 10% is comprised of various additives for enhancing the properties of the composite such as the lubricity, stiffness, dielectric properties, color and the like. The composition of materials may be varied depending upon utility requirements. For example, in circumstances where high impact resistance is required, the reinforcing material (e.g., fiberglass) may constitute 50% or 60% by weight or volume of the material with the filler being correspondingly reduced and the binder also being appropriately adjusted. As contrasted with steel or wood panels, the door panels 10, 12 are rust and corrosion resistant, dent resistant, impact resistant, may be molded to replicate wood or other patterns and may be stained, painted or otherwise coated. The panels 10, 12 are made by means of a compression molding process in widths up to sixteen (16) or more feet and in heights that vary but typically will be in the range of two (2) to four (4) feet.

By using the particular starting materials or ingredients in the manufacture of the panels 10 and 12, enhanced structural integrity is provided as well as thermal stability. That is, the material is stable in excess of 400° F. as well as at significantly low temperatures of −40° F. and lower. The material is more useful than a vinyl or wood frame door or door comprised of steel materials or a door having layers of other coating materials of plastic thereon. Additionally, construction of a panel utilizing the techniques and materials described enables design of very tight tolerances which enhances the pinch proof characteristics and the other operational characteristics of the door.

Referring to the figures, a typical rectangular panel 10 includes lateral or side edges 14 and 16, a top horizontal edge 18 and a bottom horizontal edge 20. The panel 10 is molded, as described above, in a compression molding process. The panel 10 further includes a front face 22. The front face 22 may be molded with a decorative pattern. The pattern may, for example, replicate raised wood trim or may otherwise be of a desired aesthetic nature depending upon the construction of the mold. The thickness of the molded front face 22 is typically in the range of 0.100" +0.062" or −0.0315" depending upon the particular requirements with respect to size and usage of the garage door. In a typical molded assembly, all of the ribs described below as well as the front face and edge's will have the same thickness dimensions though all dimensions may be varied depending upon the requirements with respect to use of the door.

The top edge 18 has a surface 21 with an arcuate, convex cross sectional shape curving from the front face 22. The top edge 18 is opposed to the straight or planar edge of the bottom edge 20 of the next vertically adjacent panel. Thus, when the panels 10, 12 are articulated one with respect to the other, the bottom edge 20 will move along the surface 21 defined by the top edge 18 to thereby minimize any gaps or pinch points between the panels 10 and 12, as those panels 10, 12 are articulated one with respect to the other. The arcuate extent of the edge 18 is approximately that of the height of the reinforcing ribs on the back side of the panel 10 described below.

The front face 22 includes a back side 24. The back side 24 is generally planar and a pattern of ribs, such as ribs 26 and 28 are molded integrally into the back side of the panel 10. The ribs 26 and 28 form a generally rectangular pattern on the back side 24. The ribs 26, 28 and certain subribs 30 and 32 are formed about the periphery of a center section 34 defined in the backside of the horizontal panel. A number of center sections 34 defined by rib patterns may be provided in horizontal array depending upon the width of the panel 10 between the side edges 14 and 16. Importantly, the rib pattern provides a way to keep the panel sufficiently rigid, yet flexible to withstand certain impacts. Thus the side edges 14 and 16 as well as the top and bottom edges 18 and 20 include a pattern of ribs which act as a reinforcement for the panels 10, 12 and which surround center sections 34 with connecting ribs along the back surface of the panel 10, 12.

It is also noted that portions of the center sections 34 may be cut out or removed and a window or light installed therein. For example, if a center section 34 is cut out or removed, it is possible to insert a polycarbonate or clear acrylic or other material as a window which will be highly scratch resistant and unbreakable. Such window materials may be effectively glued or bonded to the panel, for example, panel 10. This again increases the versatility of the construction and enables the use of manufacturing techniques at a factory site.

Spaced at appropriate intervals along the top edge 18 and bottom edge 20 are reinforced hinge leaf attachment lands or sections 36 and 38. Thus along the top edge 18 are a series of hinge leaf attachment lands 36. The lands 36 have a molded thickness and shape designed to receive a hinge leaf as discussed below. Similarly, at equal intervals, along the bottom edge 20 of each panel 10, 12 is a hinge leaf attachment land or section 38. Again, these lands 38 constitute reinforced portions of the panel 10, 12 along the top and bottom edges 18, 20 at equally spaced intervals so that the reinforced lands 36, 38 are in opposition one to the other when the panels 10, 12 are appropriately aligned side to side.

The hinge leaf attachment lands 36, 38 have a multiplicity of uses. They are used to hinge adjacent panels 10,12 together by coaction with hinge leaves. They are used to attach bottom edge stripping material to the lower panel 12 in the assembly of door panels 10, 12.

Hinge leaf attachment land or section 36, associated with the top edge of the panel 12, is adapted to receive a first hinge leaf 40. The adjacent and opposed hinge leaf attachment section 38 associated with the bottom of the next adjacent panel 10 receives the second hinge leaf 42 which is designed to be cooperative with the first hinge leaf 40 as well as the construction of the top edge 18 of the panel 12. That is, the construction of the hinge leaves 40 and 42 as well as the edges of the panels 10,12 constitutes an important feature of the invention relating to the compatibility and assembly techniques associated with the panels 10, 12 that are used to make a multiple panel garage door construction.

Thus, referring to the construction of the first hinge leaf 40, the leaf 40 includes a planar plate 44 which includes a series of openings 46 for receipt of fasteners 48 to attach the plate 44 to the hinge attachment land 36. The plate 44 is joined to a cylindrical pintle 50. The pintle 50 includes a bore 52, which in this instance has a polygonal cross section, for receipt of a shaft associated with a track wheel as described below.

The first hinge leaf 40 being attached to the attachment land 36 defines a slot or arcuate passage 54 having a cylindrical configuration when viewed in an end view of the hinge leaf 40. The slot 54 is defined by a space between the molded panel 12 and the pintle 50 of the first hinge leaf 40. The function of the slot 54 will become apparent in view of the following description.

The second hinge leaf 42 also includes a mounting plate 56 which includes openings 58 for receipt of fasteners 60 so that the plate 56 may be appropriately attached to the attachment land or section 38 of the bottom of the next adjacent panel 10. The hinge leaves 40 and 42 are thus arranged in opposed relationship when the panels 10, 12 are aligned. The second hinge leaf 42 further includes an arcuate or semi-cylindrical section 62. The semi-cylindrical section or shell 62 has an axis for its radius of curvature which is identical to that of the pintle 50 and bore 52. Thus the shell or section 62 may smoothly and easily fit or slide into the slot 54 and pivot about the axis defined by the axis of the pintle 50. The cross section shape of the semi-cylindrical section 62 is substantially identical to and congruent to that of the slot 54. The extent of the semi-cylindrical section 62 may be up to 120° of a circle in a preferred embodiment. The semi-cylindrical section 62 thus fits within and defines a range of articulation of a panel 12 with respect to a panel 10. In other words, the hinge leaves 40 and 42 may be assembled to panels 10, 12 at a factory site. The second hinge leaf 42 may then be inserted as part of the upper panel 10 into a lower panel 12 at a field site by articulating the panels 10, 12 at a greater angle (e.g., 120°) than their normal range of usage (up to 74° in a typical multiple panel door) when they are assembled or coupled as a final garage door construction. The panels 10,12 may thus be coupled or decoupled for replacement, repair or for other reasons at the construction site. Shipment of the unassembled panels may be effected in a compact, efficient manner as a result of this construction.

The semi-cylindrical section 62 includes first and second side skirts 64 and 66 which fit over the sides of the pintle 50 and more particularly over the sides of the slot 54 to thereby preclude or prevent the slot 54 from defining a pinch point and also to facilitate alignment of the second hinge leaf 42 when the leaves 40,42 are assembled.

As previously described, the pintle 50 includes a bore 52. The bore 52 is shaped to receive a shaft 68 associated with a track wheel 70 which fits within a guide track 72 associated with the sides of a garage door installation. Thus the side edges 14 and 16 of the panels 10 and 12 will include a track wheel 70 associated therewith, which track wheel 70 may have the same pivot axis as the pivot axis of the hinge leaves 40 and 42. The shaft 58 thus may lie on the pivot axis of the interconnected hinge leaves 40 and 42. Note that the shaft 68 of the track wheel 70 may be offset to accommodate the pathway of the track 72.

The bottom edge 20 of the lower most panel 12 in a series of panels forming a garage door may include an extruded edge guard 74 which is shaped to fit into the contour defined by the bottom edge 20. The edge guard 74 is attached to the panel 12 by fasteners attaching the guard to the lands 38. The edge guard 74 will typically include a slot 76 adapted to receive a flexible, rubber seal 78 or other material which acts as a seal. The seal 78 thus may be easily installed, removed and replaced. The floor seal retainer or edge guard 74 is integral with the bottom door panel 12 and provides a way to attach a cable to the panels 10, 12 which is tamper proof and provides for added safety.

The entire assembly enables construction of a door wherein there is a maximum four (4) to six (6) millimeter pinch proof gap at all moving locations or all locations of the door where parts move one with respect to the other. Note also that the hinge leaves 40 and 42 in combination with the panels 10 and 12 are easily lubricated and assembled at a construction site. The hinge members 40, 42 are not conventional hinge members and thus enable use of only door panels which are designed for assembly one with the other, thereby eliminating the hazard of utilizing component parts which are not designed for one another.

Variations with respect to the construction of an assembly are considered to be within the scope of the invention. For example, the dimensions of the panels, the number of hinge leaves which are associated with each panel and connect the panels, the particular size and shape of the track wheels, the use or lack of use of door and window elements incorporated in the panels, the arrangement of the arcuate edges of the adjacent horizontal panels may be modified, and various other variations may be incorporated in the garage door construction of the invention. The pattern of ribs on the back side of the panels may be adjusted. The decorative pattern on the front side of the panels may also be altered or changed. Thus, while there has been set forth preferred embodiments of the invention, it is to be understood that the invention is to be limited only by the following claims and their equivalents.

What is claimed is:

1. A garage door comprising, in combination:

a first, molded polymer containing panel having a generally rectangular shape including a front face, an inside face, opposite lateral sides, a bottom edge and a top edge;

a second molded polymer containing panel having a generally rectangular shape including a front face, an inside face, opposite lateral sides, a bottom edge and a top edge, said first and second panels having equal width, said first and second panels abutting together along a respective bottom edge and top edge; and first and second hinge members connecting the first and second panels along their abutting edges by attachment, respectively, to one of the panels, each of said first and second hinge members being comprised of a first leaf plate and a second leaf plate attached respectively to a land defined on the inside face of the first and second panels, said hinge members connected together to articulate with respect to one another about a hinge pivot axis, said first hinge member further including a cylindrical bearing pintle defining said hinge pivot axis, said second hinge member including a semicylindrical section defining a semicylindrical pocket for rotational support of the bearing pintle, said pocket having a lateral edge, said first panel including an arcuate bearing member forming an arcuate slot having a lateral side, said slot located between the bearing pintle and said arcuate panel bearing member to receive the semicylindrical section for rotational movement about the axis, said pintle further including a roller shaft axial bore having an axis concentric with the hinge axis, said second hinge member further including at least one lateral skirt formed on said outside edge to cover the lateral side of the slot as the hinge members articulate.

2. The garage door of claim 1 wherein the polymer material comprises a mixture of polyester and fiberglass.

3. The garage door of claim 1 wherein the polymer material comprises a mixture including at least about 30% polymeric resin.

4. The garage door of claim 1 wherein at least one panel includes an opening therethrough defining a light passage and further including a transparent, polymeric pane adhered to the panel.

5. The garage door of claim 1 wherein the first and second leaves are a molded polymer containing material.

6. The garage door of claim 1 in combination with a door track roller of the type including a wheel for riding in a door track and a projecting shaft for connection to the door, said shaft in the roller shaft axial bore.

7. The door of claim 1 wherein one of the abutting edges of the panels comprise an arcuate convex surface extending from the front face to define a minimum gap between the panels over a full range of articulation about a horizontal axis of connection between the panels.

8. A multiple panel garage door comprising, in combination:

a first polymeric, generally rectangular, molded horizontal garage door panel having a top edge, a bottom edge, opposite side edges, an outside front face and an inside face;

a second polymeric generally rectangular, molded horizontal garage door panel also having a top edge, a bottom edge, opposite side edges, an outside front face and an inside face;

the opposite side edges of the panels being vertically aligned, the bottom edge of the first panel opposed to the top edge of the second panel, said top edge of said first panel defining a convex, arcuate surface extending inwardly from the front face, said front faces and inside faces vertically aligned respectively when the door is in a vertical closed position;

said first and second panels connected together for articulation with respect to one another by a hinge, said hinge comprised of a first leaf and second leaf attached respectively to the first and second panels at the juncture of the top and bottom edges and defining a horizontal hinge axis of articulation of the first and second panels;

said first hinge leaf comprising a cylindrical pintle with a cylindrical outer surface and a plate extending from the cylindrical pintle, said plate attached to the inside face of the first panel;

said second hinge leaf comprising a semicylindrical shell slidably fitted over the pintle, and including a mounting plate extending therefrom attached to the inside face of the second panel, said semicylindrical shell slidably fitted in a slot between the pintle and a portion of the inside surface of the first panel, said slot having a generally congruent cross section with the cross section of the cylindrical shell, whereby the panels may articulate with respect to one another between a vertical door panel closed position and an angled position when the door panels articulate with respect to one another.

9. The door of claim 8 wherein the range of articulation of the panels when connected by said hinge leaves is 74° or less.

10. The door of claim 8 including first and second lateral side plates on the second hinge leaf transverse to the pivot axis and covering the sides of said slot.

11. The door of claim 8 wherein the pintle includes an axial bore for receipt of the shaft of a garage door track wheel shaft.

12. The door of claim 8 including a garage door track wheel shaft extending from the axis of rotation of the pintle of the first leaf.

13. The door of claim 8 wherein the panels include a pattern of reinforcing ribs on the inside face.

14. The door of claim 8 wherein the first and second panels each include a mounting land for mounting the respective hinge leaves, said lands positioned on the inside face.

15. The door of claim 14 wherein the ribs form a pattern defined by a rectangular frame of ribs around the circumference of the panel.

16. The door of claim 8 wherein the hinge members may be disengaged upon articulation of the panels by greater than 120°.

17. A garage door comprising, in combination:

a first, molded polymer containing panel having a generally rectangular shape including a front face, an inside face, opposite lateral sides, a bottom edge and a top edge;

a second molded polymer containing panel having a generally rectangular shape including a front face, an inside face, opposite lateral sides, a bottom edge and a top edge, said first and second panels having equal width, said first and second panels abutting together along a respective bottom edge and top edge; and first and second hinge members connecting the first and second panels along their abutting edges by attachment, respectively, to one of the panels, each of said first and second hinge members being comprised of a first leaf plate and a second leaf plate attached respectively to a land defined on the inside face of the first and second panels, said hinge members connected together to articulate with respect to one another about a hinge pivot axis, said first hinge member further including a cylindrical bearing pintle defining said hinge pivot axis, said second hinge member including a semicylindrical section defining a semicylindrical pocket for rotational support of the bearing pintle, said pocket having a lateral edge, said first panel including an arcuate bearing member forming an arcuate slot having a lateral side, said slot located between the bearing pintle and said arcuate panel bearing member to receive the semicylindrical section for rotational movement about the axis.

18. A garage door comprising, in combination:

a first, molded polymer containing panel having a generally rectangular shape including a front face, an inside face, opposite lateral sides, a bottom edge and a top edge;

a second molded polymer containing panel having a generally rectangular shape including a front face, an inside face, opposite lateral sides, a bottom edge and a top edge, said first and second panels having equal width, said first and second panels abutting together along a respective bottom edge and top edge; and first and second hinge members connecting the first and second panels along their abutting edges by attachment, respectively, to one of the panels, each of said first and second hinge members being comprised of a first leaf plate and a second leaf plate attached respectively to a land defined on the inside face of the first and second panels, said hinge members connected together to articulate with respect to one another about a hinge pivot axis, said first hinge member further including a cylindrical bearing pintle defining said hinge pivot axis, said second hinge member including a semicylindrical section defining a semicylindrical pocket for rotational support of the bearing pintle, said pocket having a lateral edge, said first panel including an arcuate bearing member forming an arcuate slot having a lateral side, said slot located between the bearing pintle and said arcuate panel bearing member to receive the semicylindrical section for rotational movement about the axis, said pintle further including a roller shaft axial bore having an axis concentric with the hinge axis.

* * * * *